US007063036B2

(12) United States Patent
Han

(10) Patent No.: US 7,063,036 B2
(45) Date of Patent: Jun. 20, 2006

(54) SYSTEM FOR CONNECTING BUOYANT MARINE BODIES

(75) Inventor: Lei Han, Singapore (SG)

(73) Assignee: Defence Science & Technology Agency (SG)

( * ) Notice: Subject to any disclaimer, the term of this patent is extended or adjusted under 35 U.S.C. 154(b) by 0 days.

(21) Appl. No.: 10/527,901

(22) PCT Filed: Jul. 29, 2003

(86) PCT No.: PCT/SG03/00178

§ 371 (c)(1),
(2), (4) Date: Mar. 14, 2005

(87) PCT Pub. No.: WO2004/024555

PCT Pub. Date: Mar. 25, 2004

(65) Prior Publication Data

US 2005/0263056 A1 Dec. 1, 2005

(30) Foreign Application Priority Data

Sep. 13, 2002 (SG) ..... 200205517-6

(51) Int. Cl.
*B63B 7/04* (2006.01)

(52) U.S. Cl. ..... 114/352; 114/263

(58) Field of Classification Search ..... 114/77 A, 114/77 R, 249, 263, 352
See application file for complete search history.

(56) References Cited

U.S. PATENT DOCUMENTS 3,366,915 A * 1/1968 Miller ..... 439/295
3,386,117 A 6/1968 Sterner (Continued)

FOREIGN PATENT DOCUMENTS

EP 0128976 6/1983

(Continued)

OTHER PUBLICATIONS

Australian Search and Examination Report, Singapore Application No. 200205517-6 dated Feb. 25, 2005, 8 pages.

(Continued)

*Primary Examiner*—Stephen Avila
(74) *Attorney, Agent, or Firm*—Harness, Dickey & Pierce, P.L.C.

(57) ABSTRACT

A system for connecting a two buoyant marine body in a side to side manner, the system comprising first male and female coupling members fixed to the side of a first and second marine body and Second male and female coupling members which are fixed to the side of a first and second marine body. The first male and female coupling members have an opposing relationship and can be moved from an unengaged condition to a fully engaged condition by the movement of the first and second floating marine bodies towards each other in a first horizontal direction. The freedom of movement between the male coupling and the female coupling members, at least in the vertical direction, is decreased as they become vertically aligned. Second male and female coupling members will create a rigid coupling to prevent relative movement in at least the vertical direction, as the freedom of movement between the first male and female coupling members is or is proximate to being vertically aligned. The first male coupling member is of a resiliently flexible nature and can take any impact loading between the two bodies. A securing device is included to attach the buoyant marine bodies together in a horizontal direction.

20 Claims, 4 Drawing Sheets

U.S. PATENT DOCUMENTS

| | | | | | |
|---|---|---|---|---|---|
| 3,736,722 | A | * | 6/1973 | Rosenberg | 53/526 |
| 3,756,184 | A | | 9/1973 | Hutto | |
| 3,799,100 | A | | 3/1974 | Marriner | |
| 3,916,468 | A | * | 11/1975 | Tetreault et al. | 114/352 |
| 4,290,382 | A | | 9/1981 | Conti et al. | |
| 4,335,670 | A | | 6/1982 | Skaalen et al. | |
| 4,474,504 | A | * | 10/1984 | Whitman et al. | 405/16 |
| 4,695,184 | A | | 9/1987 | Robishaw et al. | |
| 5,281,055 | A | * | 1/1994 | Neitzke et al. | 405/219 |
| 5,301,629 | A | * | 4/1994 | Kleyh et al. | 114/352 |
| 5,606,929 | A | | 3/1997 | Huang | |
| 5,947,050 | A | * | 9/1999 | Eva et al. | 114/263 |
| 6,179,525 | B1 | * | 1/2001 | Gruhn et al. | 405/219 |

FOREIGN PATENT DOCUMENTS

| | | |
|---|---|---|
| EP | 0312139 | 11/1992 |
| JP | 56-005292 | 1/1981 |
| JP | 02-106487 | 4/1990 |
| JP | 04-185592 | 7/1992 |
| JP | 11-045225 | 1/1999 |
| WO | WO 01/54969 | 8/2001 |

OTHER PUBLICATIONS

PCT International Search Report, International Application No. PCT/SG03/000178, dated Nov. 20, 2003, 5 pages.

* cited by examiner

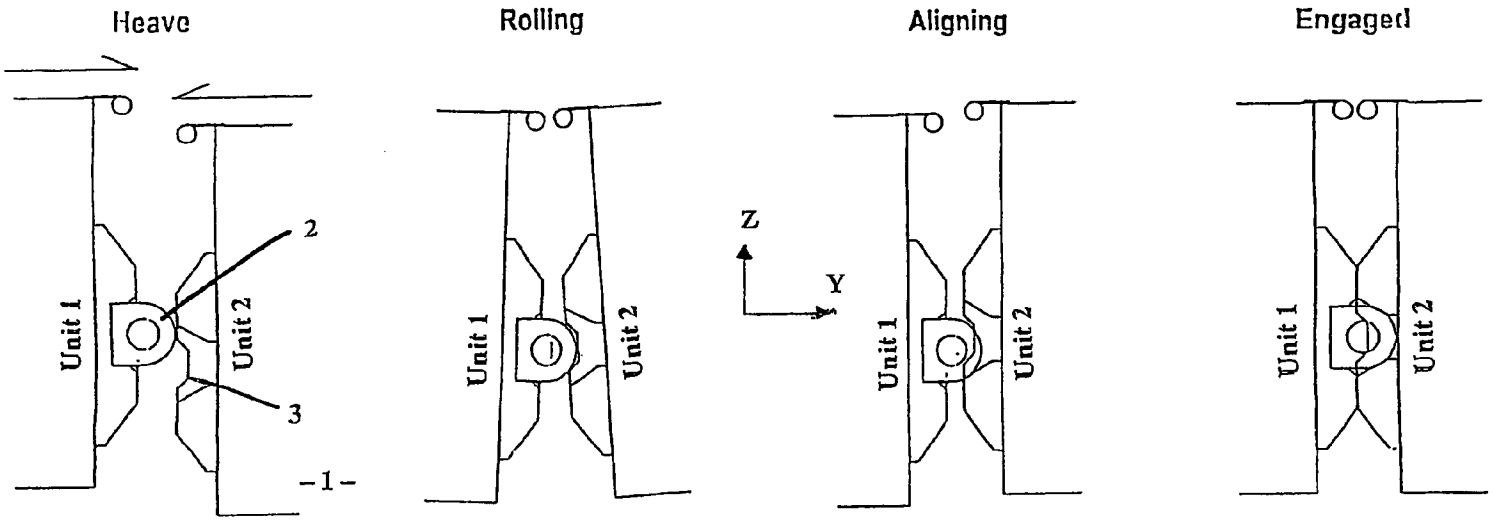
Fig 2a
Fig 2b
Fig 2c
Fig 2d
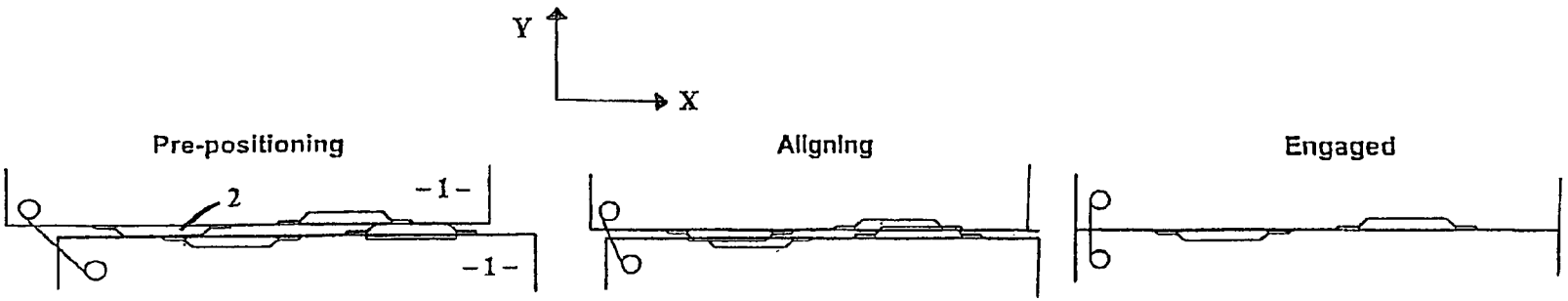
Fig 3a
Fig 3b
Fig 3c

SYSTEM FOR CONNECTING BUOYANT MARINE BODIES

FIELD OF INVENTION

The present invention relates to a system for connecting at least two buoyant marine bodies together and in particular although not solely to securing pontoons together in an end to end relationship.

BACKGROUND

Floating marine bodies such as platforms, including pontoons or barges often need to be joined together to create a larger overall working surface such as to define a bridge or the like. Such platforms can also be utilised as a floating base for marine vehicle refilling or troop loading and to support helicopter operations or to isolate risky operations.

However the key technical challenge for constructing such joined floating platforms lies in the connector design which must address the difficulties relating to the relative motion between two platforms particularly in rough seas during the connection operation. The connector design must be able to sustain the dynamic forces as a result of the wave motion both during and once the connection has been established.

The relative vertical motion of two platforms can result in a relative movement between the two connecting units of more than 0.5 m (when for example a platform is 40 m long and 7 m wide and operating in sea state three). In such conditions it would be very difficult for the operator to catch the right timing when the two platforms are in a condition where the connection units are aligned in order to connect the platforms together manually. It is also extremely dangerous to the operator working at the edges of the platform as these not only move up and down but can also knock together. Such movement may be sufficient to knock the operator from his/her feet and thereby potentially causing serious or fatal injuries.

Several designs have addressed various problems with connecting two platforms together and such designs have been mentioned for example in the patent specifications of U.S. Pat. No. 4,290,382, U.S. Pat. No. 3,386,117, U.S. Pat. No. 4,695,184, JP 20203488 and U.S. Pat. No. 5,606,929. The devices mentioned in these patent specifications all utilise a guided coupling pair which allows for the two platforms to become increasingly aligned as the two platforms are brought together. However the coupling pairs are still in a rigid form and can cause significant impact loading on each other particularly when the engagement process is not complete.

It is accordingly an object of the present invention to provide a system for connecting at least two buoyant marine bodies together wherein during engagement, the severity of impact loading between the two bodies is able to be absorbed or which will at least provide the public with a useful choice.

BRIEF DESCRIPTION OF THE INVENTION

In a first aspect the present invention consists in a system for connecting a first buoyant marine body to a second buoyant marine body in a side to side manner, said system comprising;

first male and female coupling members fixed respectively at the side of said first buoyant marine body and said second buoyant marine body second male and female coupling members fixed respectively at the side of one or the other of said first and second marine bodies said first male and female coupling members having an opposing relationship when the side of said first buoyant marine vessel is placed adjacent the side of said second buoyant marine vessel, the opposing relationship being such that as the first male and female coupling members are moved from an unengaged condition to a fully engaged condition by the movement of the first and second floating marine bodies towards each other in a first horizontal direction, the freedom of movement between the male coupling and the female coupling members, at least in the vertical direction, is decreases as they become vertically aligned said second male and female coupling members having an opposing relationship when the side of said first buoyant marine body is placed adjacent the side of said second buoyant marine body, the opposing relationship being such that rigid coupling between said second male and female coupling members occurs, to prevent relative movement in at least the vertical direction, as the freedom of movement between the first male and female coupling members is or is proximate to being vertically aligned the one or both of the first male and female coupling member being of a resiliently flexible nature and securing means to be attached to said first and said second buoyant marine body to selectively prevent separation in said first horizontal direction of said first and second male and female coupling members.

Preferably the first male and female coupling members when moved from an unengaged condition to a fully engaged condition by the movement of the first and second buoyant marine bodies towards each other, the freedom of movement of the first male coupling member within the female coupling member in a horizontal direction lateral to the first horizontal direction is also decreased.

Preferably said first female coupling is a recess which includes an upper and lower substantially horizontally extending inwardly facing contact regions which define the limits of vertical movement of the first male coupling member as these are in a non-unengaged condition.

Preferably the first male coupling member includes upper and lower substantially outwardly facing and horizontally extending contact regions, presented to engage with respective to upper and lower contact regions of the first female coupling member, said upper and lower regions of the first male coupling member, when viewed in a horizontal direction lateral to said first horizontal direction, becoming progressively more proximate to the upper and lower regions of said first female coupling member as the distance between said first and second buoyant bodies decreases.

Preferably the upper and lower contact regions of the first male coupling member are defined by surface of a configuration such they are in simultaneous contact with the respective upper and lower contact regions of the first female coupling member when in the fully engaged condition.

Preferably the first male coupling member is of an exterior shape which, in a vertical cross section and substantially parallel to the first horizontal direction, is substantially "D" shaped with the base thereof positioned proximate most to said first buoyant body and extending substantially vertically.

Preferably the upper and lower regions of the first male coupling member with which the upper and lower regions of the first female coupling member are to respectively contact, is tapered (whether curved or linearly) when viewed in a horizontal direction laterally to the first horizontal direction, said taper being such as to decrease the vertical clearance between the first male coupling member and first female coupling pair as it approaches the fully engaged condition.

Preferably said first male coupling member includes lateral surfaces which are substantially vertical and angled relative to the first horizontal direction to define a tapered configuration of the first male coupling member when viewed in plan view, the larger width portion thereof being proximate most the first buoyant marine body.

Preferably the first female coupling includes two opposing lateral guide surfaces which extend substantially vertically and are angled relative to the first horizontal direction to define a tapered configuration with the mouth opening between said two opposing surfaces being wider than the base width between said two opposing surfaces.

Preferably the lateral surfaces of the first male coupling member can be guided by the two opposing lateral guide surfaces when travelling from the unengaged condition to the fully engaged condition and to become both engaged with the two opposing lateral guide surfaces when in the fully engaged condition.

Preferably second male coupling member protrudes (in the first horizontal direction) less than and preferably less than half the distance from its respective first or second buoyant marine body than the distance that the first male coupling protrudes from the first buoyant marine body.

Preferably the depth (in the first horizontal direction) of extension of said second male coupling member into said second female coupling member is less than the depth (in the first horizontal direction) of extension of said first male coupling member into said first female coupling member.

Preferably said first mentioned depth is less than half said second mentioned depth.

Preferably said first mentioned depth is less than one third said second mentioned depth.

Preferably said first mentioned depth is less than one quarter said second mentioned depth.

Preferably said the side of said first buoyant marine body at which said first male coupling member is positioned is the stern side thereof and the side of said second buoyant marine body at which said first female coupling member is positioned, is the bow side thereof.

Preferably said the side of said first buoyant marine body at which said first male coupling member is positioned is the port side thereof and the side of said second buoyant marine body at which said first female coupling member is positioned, is the starboard side thereof.

Preferably said the side of said first buoyant marine body at which said first male coupling member is positioned is the stern side or bow side thereof and the side of said second buoyant marine body at which said first female coupling member is positioned, is the port or starboard side thereof.

Preferably the sides of said first and second buoyant marine bodies are substantially straight sides (when viewed in plan view).

Preferably said first buoyant marine body has fixed thereto at least one first male coupling member and at least two of either said second male or female coupling members to at least one side thereof.

Preferably said first buoyant marine body also includes a said first female coupling member to engage with a corresponding said first male coupling member of said second buoyant marine body.

Preferably said first buoyant marine body has fixed thereto a pair of second male coupling members and a pair of second female coupling members to at least one side thereof.

Preferably each of said pair are positioned at each end (horizontal) of a respective first male and female coupling members.

Preferably said buoyant marine bodies are barges.

Preferably said buoyant marine bodies are pontoons.

In a second aspect the present invention consists in a buoyant marine body system for the creation of a flexible in configuration floating marine structure, said pontoon system comprising of a plurality of said pontoons each incorporating the system for securing as hereinbefore described.

Preferably the system for securing is identical for at least two of said pontoons of said pontoon system.

Preferably the system for securing is identical for all of said pontoons of said pontoon system.

Preferably the system for securing is provided at the bow and stern sides of each pontoon of said pontoon system to allow for end on end engagement of at least two pontoons.

In a further aspect the present invention consists in a coupling for connecting two buoyant marine bodies together in a side to side relationship, said coupling comprising a first male coupling member fixed and protruding at the side of a first of said two buoyant marine bodies a first female coupling member fixed at the side of a second of said two buoyant marine bodies said female coupling member being a horizontally extending channel having an opening through which said male coupling member can move to in a horizontal direction to become engaged therewith said first male and female coupling members positioned to so that when in full engagement said first and second buoyant marine bodies are in a side by side relationship and relative vertical movement is limited by such engagement, a second male coupling member fixed and protruding at the side of one of said first or second of said two buoyant marine bodies a second female coupling member fixed at the side of the other of said first or second of said two buoyant marine bodies to which said second male coupling member is fixed said second female coupling member being a recess having an opening via through which said male coupling member can move to in a horizontal direction once the first male and female coupling members approach a full engagement and to become engaged with each other to rigidly prevent movement relative to each other is at least a vertical direction, the relationship between said first male and female coupling members being such that a graduated and reducing limitation in movement in the vertical direction occurs as the two buoyant marine bodies move closer to each other, as least one of said first male and female coupling members being of a resiliently flexible nature and wherein fastening means are provided to hold said two buoyant marine bodies together when said first and second male and female coupling members are engaged.

his invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF THE DRAWINGS

FIGS. 2A–2D illustrate a side view of the complimentary shaped regions of two pontoons in the process from moving from an unengaged condition to an engaged condition.

FIGS. 3A–3C illustrate a plan view of the end regions of two pontoons and their movement laterally from an unengaged condition to an engaged condition.

DETAILED DESCRIPTION OF THE INVENTION

Figure 1:
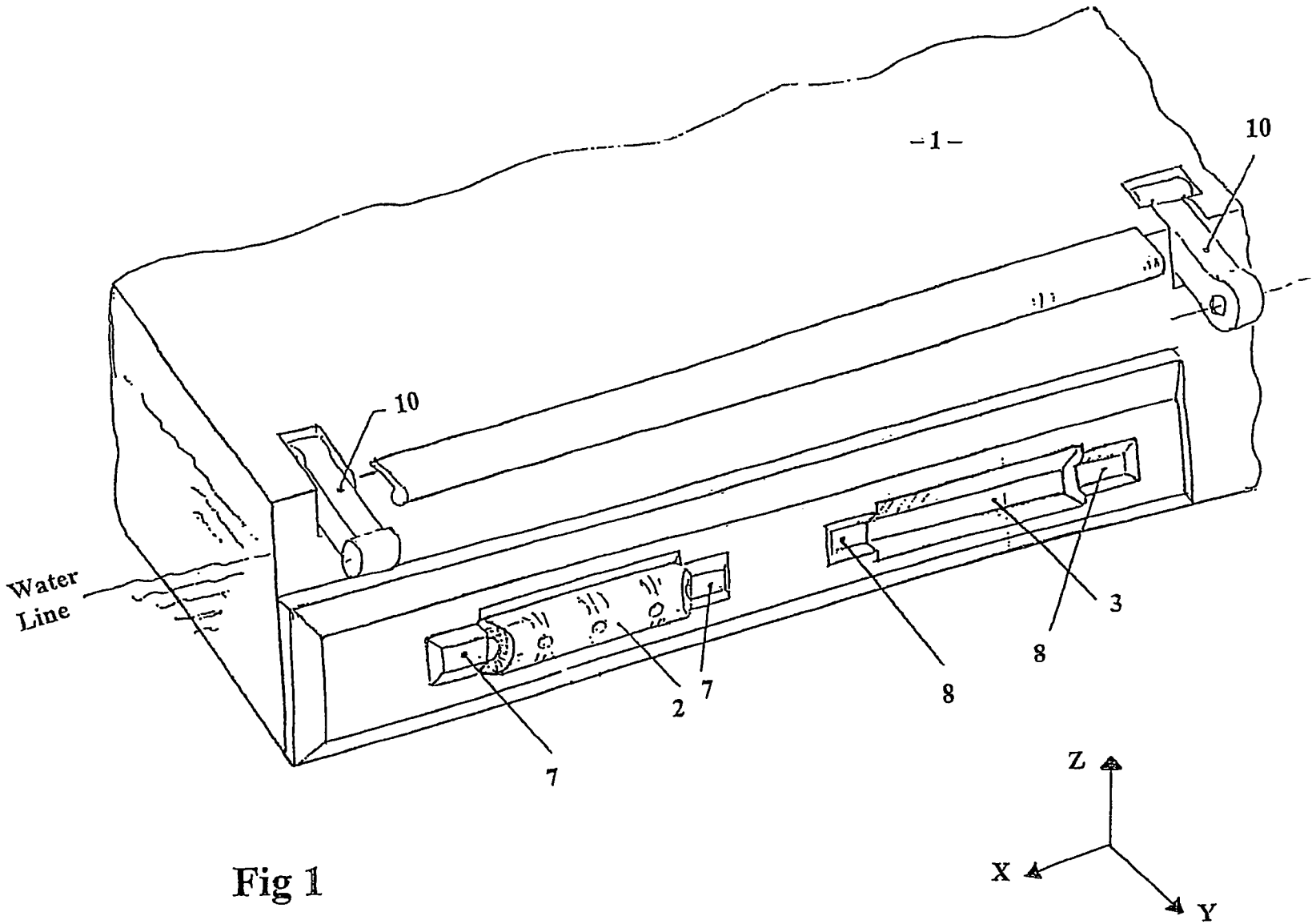
FIG. 1 is a perspective view of part of a pontoon showing in detail the features of one side of the pontoon which has been adapted for interconnection with a substantially complimentary shaped side of a second pontoon (not shown)
Figure 10:
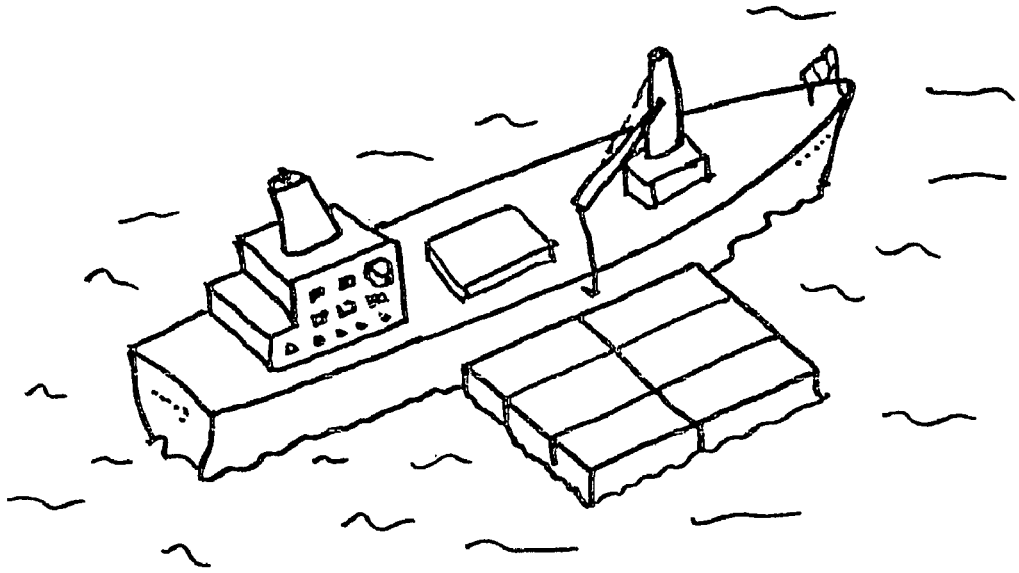
FIG. 10 is a view of pontoons connected sided to side in both on end on end relationship and port to starboard side relationship, showing an application for such a system to create a working platform adjacent a ship.

With reference to FIG. 1 there is shown a buoyant marine body such as a pontoon 1 which has provided at, at least one side thereof, features for the engaging the pontoon 1 with a similar or like pontoon. The pontoon 1 may also be a barge, platform or other buoyant marine body or vessel and which is engageable to like bodies or vessels to form a greater overall floating arrangement. By way of example, pontoons in military applications may be used to form a bridge over a body of water. Likewise pontoons may be joined together and be positioned adjacent a vessel for the purposes of establishing a working surface which is more proximate to the water level adjacent a larger vessel as show in FIG. 10. Other applications include breakwater construction, ship to ship bridging, ship to shore bridging, a marine jetty and to provide the floatation pontoons for fish farm enclosure.

In a usual form such a pontoon will be of a square or rectangular plan shape and will provide four sides which may for example be considered a bow and stern side and port and starboard side. The present invention is not limited to the provision of the securing features at only one side of the pontoon and indeed such may be provided at any side or any number of the sides. In the application where the pontoons are used for defining a bridge structure, the bridge is normally defined by the positioning of pontoons in a bow to stern manner and hence in this form it will the shorter length bow and stern sides of the pontoon which are provided with the securing features.

The pontoons of such a system are preferably substantially identical and the securing features provided at such opposing ends are substantially complimentary shaped. A securing feature is provided at at least one side of a pontoon and comprises a first male coupling member 2 which is to engage with a female coupling member 3 of an adjacent pontoon. Two pontoons when floating on water have the first male and female coupling members 2, 3 positioned at a height which is substantially the same relative to the waterline. With reference to FIGS. 2A–2D, the two pontoons may move relative to each other in for example the Z direction as a result of wave action and the first male and female coupling members can move in a vertical direction (Z direction) relative to each other when they are not aligned as for example shown in FIG. 2A. Coupling of the first male coupling member 2 with the first female coupling member 3 occurs as the two pontoons are brought more proximate to each other in a first horizontal direction (Y direction).

The first male and female coupling members are for example provided on a vertical side face of each of the first and second pontoons and as the pontoons are brought more proximate to each other, the first male coupling member 2 will at least in part become located within the first female coupling member 3. As the pontoons are brought more proximate to each other the first male member 2 will move to become engaged with the female member to prevent relative movement in the Z direction. As the pontoons may be assembled in an end—end relationship in sea states where relative movement between the two pontoons occurs, the relationship between the first male and female coupling members is such that a guiding engagement occurs. At the initial stages of engagement, the fit between the first male and female coupling members is relatively loose and the pontoons can move in a limited manner in the Z direction relative to each other. The first female coupling member 3 may include a mouth opening and a tapered recess which tapers inwardly as it progresses downwardly towards the bottom of the recess as for example shown in FIG. 1. Its preferred shape is "V" or "U" shaped. Alternatively or in addition, the first male coupling member 2 is of a tapered nature. With reference to FIG. 2A, it is of a non linear taper and indeed is preferably semi circular (or "D" shaped) when viewed from the side in a horizontal direction (X axis direction) which is lateral to the direction of horizontal engagement (Y direction).

Figure 6:
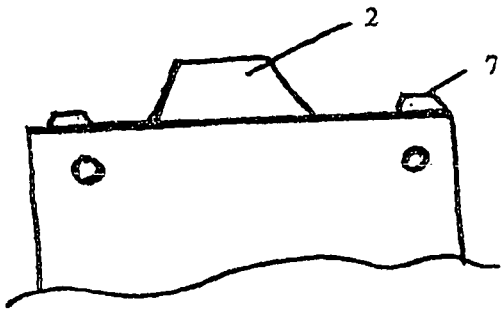
FIG. 6 is a plan view of an alternative configuration of the end of a pontoon.

Significant movement between the two pontoons is induced by variation in the waterline level as result of the wave action (and a relative movement of the two pontoons hence being in the Z direction). The taper is provided to decrease the degree of freedom of movement in the Z direction between the two pontoons during the engagement process as it moves to a stage where the two pontoons are fully engaged. With reference to FIG. 6 which is a plan view of a pontoon, it can also be seen that a taper in the X-Y plane may be provide at the ends of the first male coupling members 3. Such a taper is provided to decrease the degree of freedom of movement in the X direction (horizontal and in a direction lateral to the engagement direction (Y) of the two pontoons) and to guide any lateral miss alignment of the two pontoons in the X direction (see FIGS. 3*a*–3*c*).

A taper of the first female coupling member 3 which corresponds to the taper of the first male coupling member in the Z-Y direction may be provided. When the two pontoons are in a fully engaged condition, the first male coupling member is located securely within the first female coupling member and any significant relative movement therebetween at least in the X direction and preferably also in the Z direction between the two pontoons is thereby prevented or at least significantly reduced.

The first male and female coupling members may be of a complimentary shape. In the preferred from the first male coupling member is substantially D shaped in a vertical cross section taken parallel to the direction of engagement (Y direction). The male coupling member is preferably made of a resiliently flexible material such as a rubber or plastics material. Impact between the first and second pontoon is preferably absorbed by the first male coupling member as result of its material selection. The first male coupling member hence also acts as a fender during the coupling process. The first female coupling member may instead be flexible or both may be flexible. With reference to FIGS. 3A–3C, it can be seen that the first male coupling member 3 during the engagement process can be positioned to fend between the first and second pontoons. When no correct alignment for complete engagement between the two pontoons is provided, the first male coupling member 2 will not be in alignment with the first female coupling member 3 and movement between the two pontoons which may create impact between the two pontoons is absorbed by the first male coupling member 2 to thereby lessen any impact damage between the two pontoons.

Figure 8:
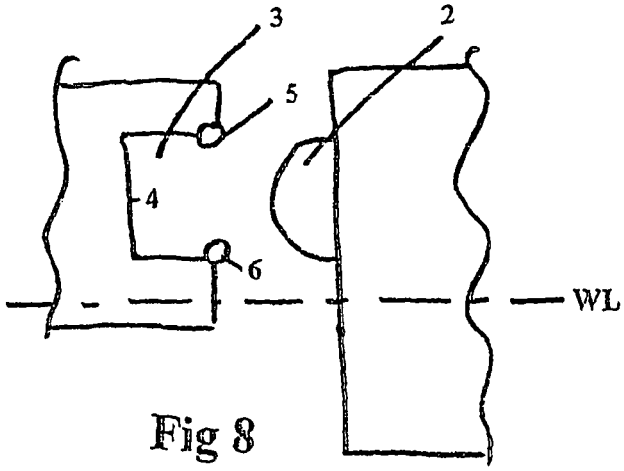
FIG. 8 is a side view of an end region of two pontoons in an alternative configuration.
Figure 9:
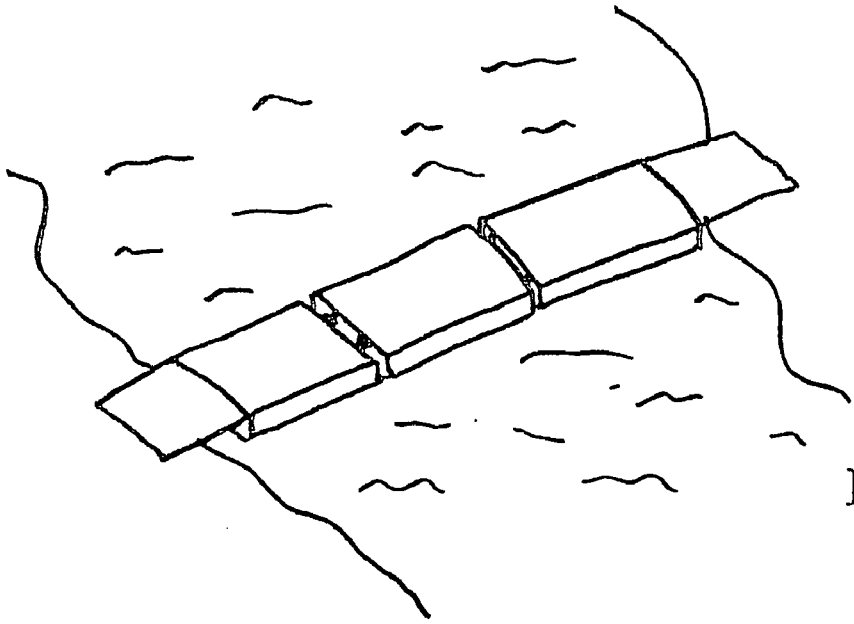
FIG. 9 is a view of a series of pontoons connected side to side in an end on end relationship to for a bridge from shore to shore.

With reference to FIG. 8, it can be seen that the female coupling member 3 need not necessarily be of a complimentary shape to the male coupling member 2. The male coupling member (being preferably of a D shaped vertical cross section) can move into the recess 4 of the first female coupling member 3 and be guided by substantially horizontally extending upper and lower edges or surfaces 5, 6 at the mouth opening of the recess 4 of the first female coupling member 3.

In the most preferred form the first male and female coupling members 2, 3 are of an elongate nature (extending in the X direction) as for example shown in FIG. 1. By being of an elongate nature, motion in not just the Z direction between the two pontoons can be absorbed by the fender but also a roll of the two pontoons about the Y axis can be absorbed.

In the most preferred form each pontoon is preferably provided with at least two first male/female coupling members spaced apart in the X direction. With reference to FIG. 1 it can be seen that at, at least one side of the pontoon there is provided a first male coupling member 2 and a first female coupling member 3. Each of these is to engage with a complementary first female and first male coupling member of an adjacent pontoon. Although it is preferred that one first male and one first female coupling member is provided at at least one side of a pontoon, it may merely be one first male coupling member that is provided or perhaps one or two first male coupling members. Indeed a plurality of first male coupling members or first male/first female coupling members may be provided along at least one side of the pontoon, particularly if the sides are relatively long.

The first male and first female coupling members may be provided above or below the waterline of the pontoons.

Figure 4:
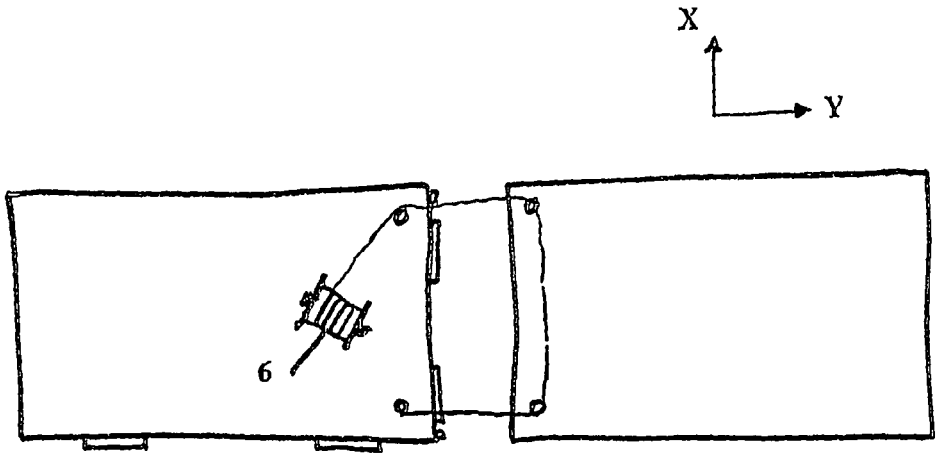
FIG. 4 illustrates a plan view of two pontoons in an unengaged condition and wherein a rope or cable may be used to draw the two pontoons together.
Figure 5:
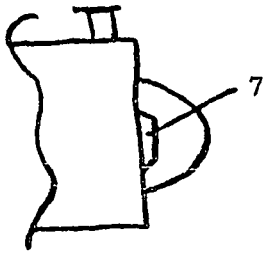
FIG. 5 is a side view of an end region of a pontoon.

The two pontoons may be brought more proximate to each other by the use of a cable or rope or the like which may be rigged as for example shown in FIG. 4. A rope is adjustable in length by a winch 6 to draw the two pontoons together. The rope may be provided at deck level (above the position of the first male and preferably second and female coupling members) and by the winding of the winch can draw the two pontoons (in the Y direction closer together). This rope may also to some extent create an alignment in the X direction between the two pontoons.

The same side or sides of the pontoon from which the first male and/or female coupling members are provided, also include a second male or female coupling member(s) 7,8. A second male coupling member 7 may for example be provided at the same side as the first male coupling member 3 as for example shown in FIG. 1. The second male coupling member 7 protrudes from the side of the pontoon in a manner to be engageable with a second female coupling member 8 of an adjacent pontoon. The second female coupling member 8 is a rebate or recess with which the second male coupling member 7 can engage. Engagement occurs by the movement of the pontoons more proximate to each other along the Y axis. The second male coupling member 7 and second female coupling member 8 are of a nature such that when they are fully engaged, no movement between the two pontoons in at least the Z direction (and preferably also the X direction) can occur. In fact the shear loading that is created by the differential forces applied to the pontoons by the sea state in both the Z direction and X direction are carried by the second male and female coupling members. The rebate of the second female coupling member 8 is substantially of a complimentary shape to the shape of the second male coupling member 7. When the pontoons, in the Y direction, are in an engaged condition, the second male coupling member 7 locates without any significant freedom of movement in the X and Z directions in the second female coupling member 8.

The protrusion of the second male coupling member 7 from the side of a pontoon is to a degree less and preferably significantly less than the protrusion of the first male coupling member 2 from the same side of the pontoon or of a mating pontoon. The engagement process of the second male and female coupling members hence occurs at a stage where a coupling between the first male and female coupling members has been advanced to a significant stage. Hence during engagement of the first male and female coupling members, no contact between the second male and female coupling members occurs at least for a significant distance of travel of the two pontoons towards each other. Contact of the second male and female coupling members is made as the first male and female coupling members approach a fully engaged condition. The second male and female coupling members then become engaged with each other. Although preferably such engagement is also a graduated engagement in that at the initial stages of coupling a degree of freedom of movement if allowed, the distance of travel required for a full engagement to occur of the second male and female coupling members is significantly less than compared to that for the first male and female coupling members. The second male coupling member 7 is preferably made of a rigid material such as a metal. The relationship between the second male and female coupling members when fully engaged is a rigid relationship. The engagement of the second male and female coupling members does not occur until the two pontoons are substantially proximate to their fully engaged position along the Y axis direction. As the first male and female coupling members are at such point to be engaged with each other, the relative movement between the two pontoons at least in the Z direction and preferably also in the X direction has been significantly reduced by the first male and female coupling members. Accordingly relative movement between the second male and female coupling members along the X and Z directions is also significantly reduced and the second male and female coupling members are then in a substantial alignment such that continued movement of the two pontoons closer together will engage the second male and female coupling members without significant impact occurring therebetween. A slight taper may like the first male coupling member, be provided on the second male coupling member 7 such that the engagement of the second male and female coupling members is also a guided engagement.

A pontoon may be provided with at least one second male coupling member 7 and the second female coupling member provided on an adjacent pontoon. However there is preferably provided two second male coupling members on a pontoon to be engaged with corresponding two second female coupling members on an adjacent pontoon. In the most preferred form, there are provided two second male coupling members 7 adjacent the longitudinal ends of the first male coupling member 2. This is for example shown in FIG. 1.

In the arrangement shown in FIG. 1 one first male and one first female coupling members are provided positioned adjacent each other and preferably axially aligned along the X direction axis, a pair of female second coupling members may be provided adjacent the longitudinal ends of the first female coupling members and a pair of second male coupling members may be provided at the longitudinal ends of the first male coupling member. It will be appreciated that conversely the first male coupling member 2 may be flank by two second female coupling members or a combination of such.

Once the pontoons are in an engaged condition, they may be held in such a relationship to prevent movement apart from each other in the Y direction, by the use of fastening means 10. Such fastening means can span between the two pontoons and engage the two pontoons axially together to thereby prevent relative movement of the two pontoons at least to a significant degree in the Y direction. The fastening means 10 hence will ensure that the first and second male and female coupling members do not separate from each other and are kept in an engaged condition such that they transmit any force differential between the two pontoons in the X and Z directions. Such fastening means may preferably be of a quick fit fastening means such that when alignment does occur between the two pontoons, the fastening means can operate relatively quickly to lock the two pontoons together. The faster is positioned above the first and second male and female coupling members. The faster could also be positioned in line or below the coupling members. Alternative fastening means may be used such a vacuum cup suction pads.

Figure 7:
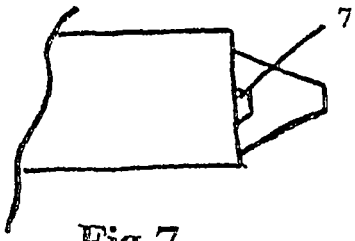
FIG. 7 is a side view of an end region of a pontoon in an alternative configuration.

Although as mentioned it is preferred that the first male coupling member 2 is of a substantially D shaped cross section, it can be seen with reference to FIG. 7 that the cross section may be of a linear taper and may include a truncation at its protruding most end.

What is claimed is:

1. A system for connecting a first buoyant marine body to a second buoyant marine body in a side to side manner, said system comprising:

first male and female coupling members fixed respectively at the side of said first buoyant marine body and said second buoyant marine body second male and female coupling members fixed respectively at the side of one or the other of said first and second marine bodies said first male and female coupling members having an opposing relationship when the side of said first buoyant marine vessel is placed adjacent the side of said second buoyant marine vessel, the opposing relationship being such that as the first male and female coupling members are moved from an unengaged condition to a fully engaged condition by the movement of the first and second floating marine bodies towards each other in a first horizontal direction, the freedom of movement between the male coupling and the female coupling members, at least in the vertical direction, decreases as they become vertically aligned said second male and female coupling members having an opposing relationship when the side of said first buoyant marine body is placed adjacent the side of said second buoyant marine body, the opposing relationship being such that rigid coupling between said second male and female coupling members occurs, to prevent relative movement in at least the vertical direction, as the freedom of movement between the first male and female coupling members is or is proximate to being vertically aligned the one or both of the first male and female coupling member being of a resiliently flexible nature and securing means to be attached to said first and said second buoyant marine body to selectively prevent separation in said first horizontal direction of said first and second male and female coupling members.

2. A system as claimed in claim 1 wherein the first male and female coupling members when moved from an unengaged condition to a fully engaged condition by the movement of the first and second buoyant marine bodies towards each other, the freedom of movement of the first male coupling member within the female coupling member in a horizontal direction lateral to the first horizontal direction is also decreased.

3. A system as claimed in claim 1 wherein said first female coupling is a recess which includes an upper and lower substantially horizontally extending inwardly facing contact regions which define the limits of vertical movement of the first male coupling member as these are in a non-unengaged condition.

4. A system as claimed in claim 3 wherein the first male coupling member includes upper and lower substantially outwardly facing and horizontally extending contact regions, presented to engage with respective to upper and lower contact regions of the first female coupling member, said upper and lower regions of the first male coupling member, when viewed in a horizontal direction lateral to said first horizontal direction, becoming progressively more proximate to the upper and lower regions of said first female coupling member as the distance between said first and second buoyant bodies decreases.

5. A system as claimed in claim 4 wherein the upper and lower contact regions of the first male coupling member are defined by surface of a configuration such they are in simultaneous contact with the respective upper and lower contact regions of the first female coupling member when in the fully engaged condition.

6. A system as claimed in claim 1 wherein the first male coupling member is of an exterior shape which, in a vertical cross section and substantially parallel to the first horizontal direction, is substantially "D" shaped with the base thereof positioned proximate most to said first buoyant body and extending substantially vertically.

7. A system as claimed in claim 4 wherein the upper and lower regions of the first male coupling member with which the upper and lower regions of the first female coupling member are to respectively contact, is tapered (whether curved or linearly) when viewed in a horizontal direction laterally to the first horizontal direction, said taper being such as to decrease the vertical clearance between the first male coupling member and the first female coupling pair as it approaches the fully engaged condition.

8. A system as claimed in claim 1 wherein said first male coupling member includes lateral surfaces which are substantially vertical and angled relative to the first horizontal direction to define a tapered configuration of the first male coupling member when viewed in plan view, the larger width portion thereof being proximate most the first buoyant marine body.

9. A system as claimed in claim 1 wherein the first female coupling includes two opposing lateral guide surfaces which extend substantially vertically and are angled relative to the first horizontal direction to define a tapered configuration with the mouth opening between said two opposing surfaces being wider than the base width between said two opposing surfaces.

10. A system as claimed in claim 8 wherein the lateral surfaces of the first male coupling member can be guided by the two opposing lateral guide surfaces when traveling from the unengaged condition to the fully engaged condition and to become both engaged with the two opposing lateral guide surfaces when in the fully engaged condition.

11. A system as claimed in claim 1 wherein second male coupling member protrudes (in the first horizontal direction) less than and preferably less than half the distance from its respective first or second buoyant marine body than the distance that the first male coupling protrudes from the first buoyant marine body.

12. A system as claimed in claim 1 wherein the depth (in the first horizontal direction) of extension of said second male coupling member into said second female coupling member is less than the depth (in the first horizontal direction) of extension of said first male coupling member into said first female coupling member.

13. A system as claimed in claim 12 wherein said first mentioned depth is less than half said second mentioned depth.

14. A system as claimed in claim 1 wherein said side of said first buoyant marine body at which said first male coupling member is positioned is the stern side or bow side thereof and the side of said second buoyant marine body at which said first female coupling member is positioned, is the port or starboard side thereof.

15. A system as claimed in claim 1 wherein said buoyant marine bodies are barges.

16. A system as claimed in claim 1 wherein said buoyant marine bodies are pontoons.

17. A buoyant marine body system for the creation of a flexible in configuration floating marine structure, said pontoon system comprising of a plurality of said pontoons each incorporating the system for securing as claimed in claim 1.

18. A system as claimed in claim 1 wherein the system for securing is identical for at least two of said pontoons of said pontoon system.

19. A system as claimed in claims 17 wherein the system for securing is provided at the bow and stern sides of each pontoon of said pontoon system to allow for end on end engagement of at least two pontoons.

20. A coupling for connecting two buoyant marine bodies together in a side to side relationship, said coupling comprising a first male coupling member fixed and protruding at the side of a first of said two buoyant marine bodies a first female coupling member fixed at the side of a second of said two buoyant marine bodies said female coupling member being a horizontally extending channel having an opening through which said male coupling member can move to in a horizontal direction to become engaged therewith said first male and female coupling members positioned so that when in full engagement said first and second buoyant marine bodies are in a side by side relationship and relative vertical movement is limited by such engagement, a second male coupling member fixed and protrading at the side of one of said first or second of said two buoyant marine bodies a second female coupling member fixed at the side of the other of said first or second of said two buoyant marine bodies to which said second male coupling member is fixed said second female coupling member being a recess having an opening via through which said male coupling member can move in a horizontal direction once the first male and female coupling members approach a full engagement and to become engaged with each other to rigidly prevent movement relative to each other is at least a vertical direction, the relationship between said first male and female coupling members being such that a graduated and reducing limitation in movement in the vertical direction occurs as the two buoyant marine bodies move close to each other, at least one of said first male and female coupling members being of a resiliently flexible nature and wherein fastening means are provided to hold said two buoyant marine bodies together when said first and second male and female coupling members are engaged.

* * * * *